United States Patent [19]

Grant

[11] Patent Number: 5,009,579

[45] Date of Patent: Apr. 23, 1991

[54] FLUID PUMP ENCASEMENT

[75] Inventor: Benton H. Grant, Stamford, Conn.

[73] Assignee: Grant Airmass Corporation, Stamford, Conn.

[21] Appl. No.: 345,030

[22] Filed: Apr. 27, 1989

Related U.S. Application Data

[63] Continuation-in-part of Ser. No. 230,462, Aug. 15, 1988, Pat. No. 4,834,625.

[51] Int. Cl.[5] ..... F04B 21/00

[52] U.S. Cl. ..... 417/413; 417/12; 417/510

[58] Field of Search ..... 417/413, 12, 442, 502, 417/510, 312, 313, 423.14; 415/119; 5/453

[56] References Cited

U.S. PATENT DOCUMENTS

| | | | |
|---|---|---|---|
| 1,666,257 | 4/1928 | Furnivall et al. . | |
| 1,721,385 | 7/1929 | Furnivall et al. . | |
| 2,788,170 | 4/1957 | Kato et al. | 417/413 |
| 3,015,835 | 1/1962 | Dyer et al. . | |
| 3,266,716 | 8/1966 | Tussey . | |
| 3,371,852 | 3/1968 | Holt . | |
| 3,467,081 | 9/1969 | Glass | 5/453 |
| 3,491,850 | 1/1970 | Heitner . | |
| 3,536,149 | 10/1970 | Laird . | |
| 3,539,276 | 11/1970 | Matsuura | 417/413 |
| 3,669,573 | 6/1972 | Levensohn . | |
| 3,692,142 | 9/1972 | Stemp . | |
| 3,695,781 | 10/1972 | LaBarber | 417/423.14 |
| 3,776,365 | 12/1973 | Richards . | |
| 3,789,954 | 2/1974 | Raleigh | 417/312 |
| 3,989,415 | 11/1976 | Van-Hee et al. . | |
| 4,186,734 | 2/1980 | Stratton | 5/453 |
| 4,197,837 | 4/1980 | Tringali et al. | 5/453 |
| 4,352,642 | 10/1982 | Murayama et al. . | |
| 4,353,434 | 10/1982 | Norris . | |
| 4,384,635 | 5/1983 | Lowery . | |
| 4,541,786 | 9/1985 | McLean | 417/407 |
| 4,610,608 | 9/1986 | Grant . | |

OTHER PUBLICATIONS

Cole-Parmer Catalogue 1987-1988, pp. 633-634.

Webster's New Collegiate Dictionary 1979, defination of Ceramic.

*Primary Examiner*—Leonard E. Smith

*Assistant Examiner*—David W. Scheuermann

*Attorney, Agent, or Firm*—St. Onge Steward Johnston & Reens

[57] ABSTRACT

An encasement is provided for improving the acoustic characteristics of fluid pumps. The encasement is substantially formed from a material selected from the group consisting of glasses, ceramics, thermoplastic resins and thermosetting resins. Further, the encasement forms a chamber open to one side for receiving and containing a fluid pump. The open side of the encasement includes a lip for mating with a base. The encasement is designed in modular fashion for relatively quick assembly and disassembly.

25 Claims, 5 Drawing Sheets

232
234
240
233
212
235
238
216
218
214
210
236
226
236
222
230
224
228
208
200
242
258
220
201
229
202
227
188
110
206
174
115
178
128
204
173
180
182
114
172
170
172
170
184
184
120
186
186
176
126
116
122
117
116
122'
116
112
176
136'
116
136

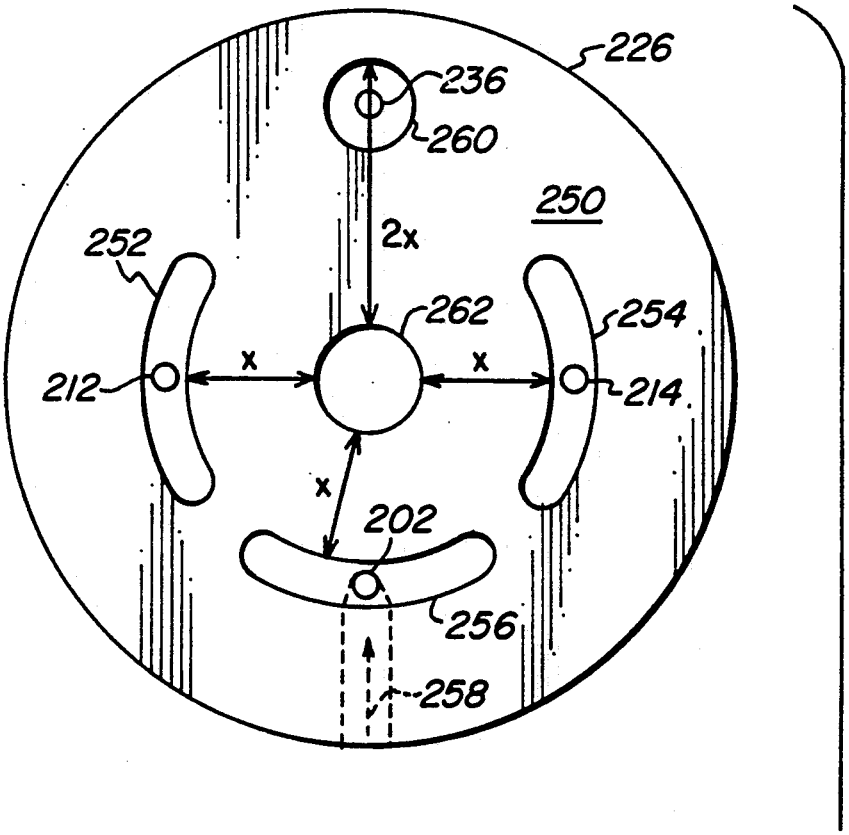
FIG. 5
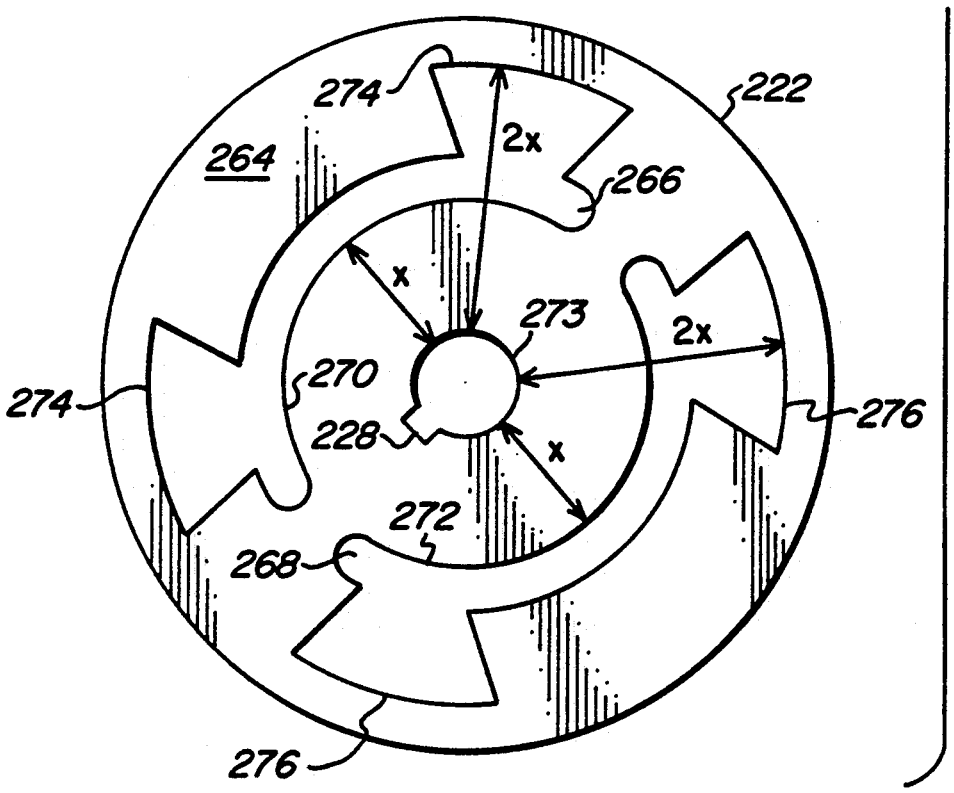

FLUID PUMP ENCASEMENT

This application is a continuation-in-part of my earlier application, Ser. No. 230,462, filed on Aug. 15, 1990, now U.S. Pat. No. 4,834,625 which is hereby incorporated by reference.

FIELD OF THE INVENTION

This invention relates generally to fluid pumps and more particularly to encasements for improving the acoustic characteristics of such pumps.

BACKGROUND OF THE INVENTION

Suppression of noise from small air pumps, which can be used for example in such widely varying applications as health care devices and household aquaria, has long been desirable because even relatively low level acoustical emissions in a home or hospital environment can be disturbing. Prior devices have proposed a variety of solutions to the problem of excessive noise and vibration with varying degrees of success.

U.S. Pat. No. 3,266,716 to Tussey discloses an air pump actuating device which reduces chatter by displacing the armature away from the electromagnet during increased loading. The device is housed in a cylindrical shell.

U.S. Pat. No. 3,371,852 to Holt discloses an air pump including leaf springs to support the shaft and eliminate problems associated with horizontal displacement of the shaft. The pump also includes an outlet control device.

U.S. Pat. No. 3,669,573 to Levensohn discloses a vibrator pump mounted to a base, preferably made of wood, having a natural frequency of vibration below the excitation frequency of the pump.

U.S. Pat. No. 3,989,415 to Van-Hee et al. discloses a silencing housing for a machine plant having a primary chamber enclosing the machine plant and having an air inlet, and a secondary chamber having both an air inlet and an air outlet to reduce air flow noise.

SUMMARY OF THE INVENTION

Despite these advances in the design and construction of small air pumps, noise and vibration have continued to produce undesirable acoustic characteristics. Thus, there exists a present need for a fluid pump encasement which substantially reduces noise and vibration.

It is an object of this invention to provide an encasement for a fluid pump which substantially reduces noise and vibration, yet is relatively economical to manufacture. It is another object of this invention to provide a fluid pump having a modular encasement so that it can be relatively quickly assembled and disassembled for repairs, or to serve a decorative function, or to incorporate a timer. It is a further object of this invention to provide an encasement for a fluid pump which reduces the noise and vibration generated by both a fluid pump and a timer.

This invention relates to an encasement for improving the acoustic characteristics of fluid pumps. The encasement forms a chamber open to one side for receiving and containing a fluid pump. Further, the one open side of the encasement includes a lip for mating with a base in a relatively snug fit. The encasement is substantially formed from a material selected from the group consisting of glasses, ceramics, thermoplastic resins and thermosetting resins. The encasement is designed in modular fashion for relatively quick assembly and disassembly.

In one embodiment, a base is clamped to a ceramic encasement with at least one substantially Z-shaped clip. The ceramic encasement is preferably a partial sphere. The modular design permits the encasement to serve a decorative function.

In a second embodiment, a base is attached to a thermoplastic resin or thermosetting resin encasement. The encasement is preferably cylindrical, and preferably formed from a thermoplastic resin. The modular design permits, if desired, a timer housing to be mounted directly to the encasement of this embodiment to further insulate the fluid pump and to incorporate a timer within the encasement. The timer functions to alternately pressurize and exhaust or vent a pair of outlet lines.

The invention and its particular features will become more apparent from the following detailed description when considered with reference to the accompanying drawings.

BRIEF DESCRIPTION OF THE DRAWINGS

FIG. 5 is an enlarged plan view of inner surfaces of a rotor and a timer plate.

DETAILED DESCRIPTION

Figure 1A:
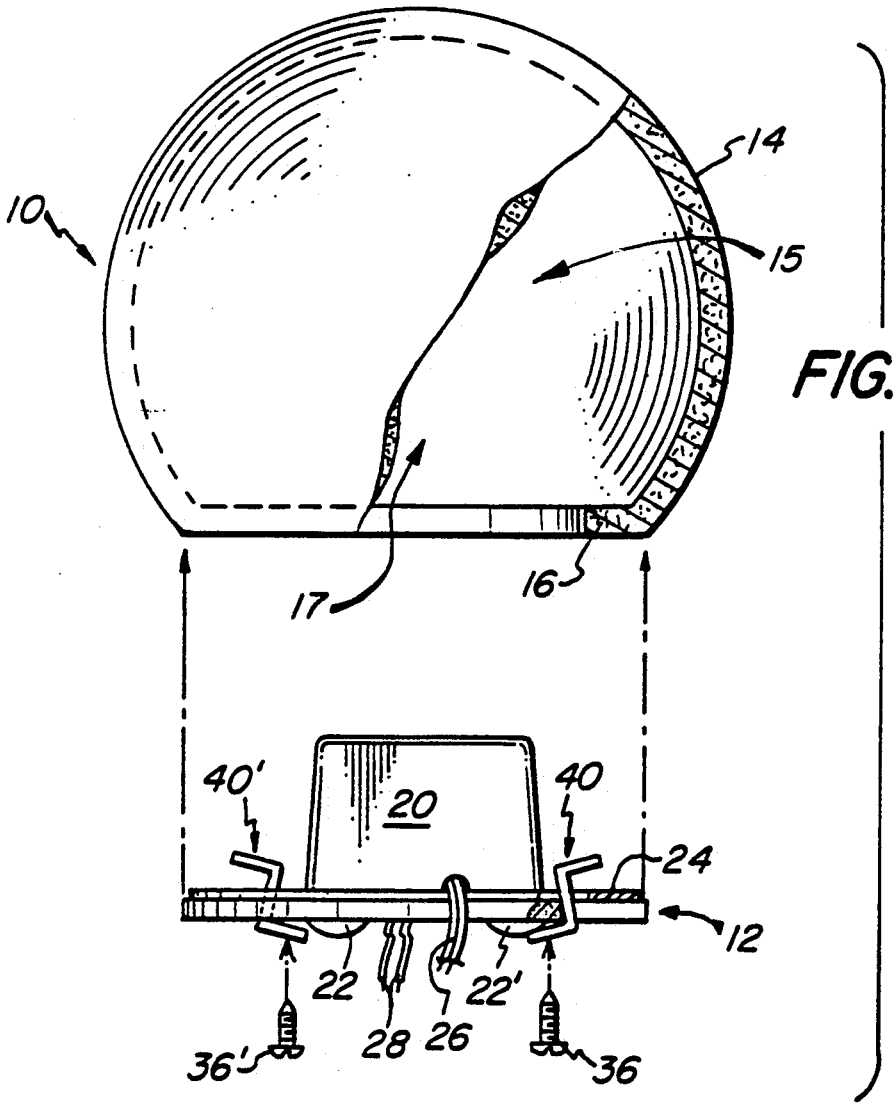
FIG. 1A is a partially exploded partially cutaway front view of a fluid pump having one embodiment of an encasement in accordance with this invention.

Referring to FIG. 1A, a fluid pump 10 is shown in a partially exploded partially cut away front view revealing a base 12, and one embodiment of an encasement or pump housing 14 in accordance with this invention. Encasement 14 is hollow forming a chamber 15 open to one side 17 for receiving and containing a pumping mechanism or pump means 20 shown schematically. Further, encasement 14 includes a lip 16 depending from the periphery of open side 17. Although lip 16 is shown depending inwardly, it may depend outwardly as well (see FIG. 4).

Encasement 14 is substantially formed from a material selected from the group consisting of glasses, thermoplastic resins, thermosetting resins, and ceramics. In this embodiment, the encasement is ceramic such as, for example, pottery. The most preferred ceramic encasement is partially spherical in shape, has an approximate diameter of about 5 inches, is approximately 3/16 inches thick, has an opening of about 4 inches in diameter, has a lip about ⅜ inches wide, and is glazed on both sides.

Base 12 may be, for example, formed from thermoplastic resin, thermosetting resin, and metals. It has been found that the material used for the base is not critical to the sound and vibration dampening qualities of the encasement so long as the base is of a substantial thickness. For this embodiment metal and more specifically steel has been found to be effective. The base is about 5 inches in diameter, is approximately 1/16 inch thick, and is circular in shape to match the opening of the encasement of this embodiment. Any other shape may be used which conforms to the encasement's opening.

Fluid pump 10 may be assembled relatively quickly and easily from modular components: encasement or pump housing 14, and base 12. This modular assembly permits not only relatively quick and easy replacement of encasement 14, but also relatively quick and easy access to pumping mechanism 20 for repair or replacement. The relative ease of replacing encasement 14 serves a decorative function as different color or pattern encasements may be interchanged to meet the appropriate room decor. Fluid pump 10 is preferably assembled from its modular components by clamping base 12 to encasement 14 in a relatively snug fit. Preferably, the clamping is achieved by at least one, and most preferably by two substantially Z-shaped clips 40 and 40'. Clips 40 and 40' are discussed in greater detail with reference to FIGS. 2A and 2B.

Figure 1B:
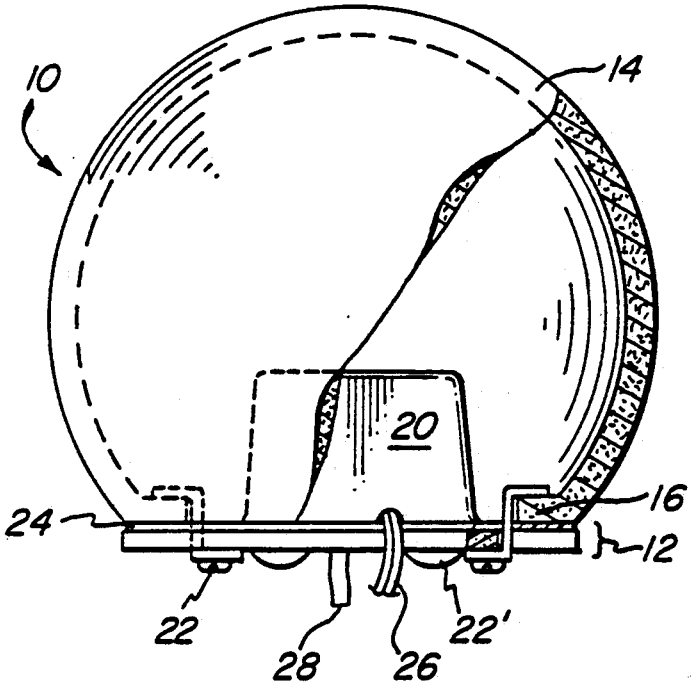
FIG. 1B is a partially cutaway front view of the encasement of FIG. 1A assembled.

Referring now to FIG. 1B, assembled fluid pump 10 is shown with a partial cutaway to reveal pumping mechanism 20 therein. Base 12 includes a circular gasket 24 of rubber, cork, or like material which aids in sealing the perimeter of base 12 to lip 16. Gasket 24 may be any shape necessary to seal base 12 to lip 16. Further, base 12 includes ports for a power cord 26 and a conduit 28 for egress of pressurized fluid from pumping mechanism 20. Also attached to base 12 are vibration absorbing feet of rubber, cork or like material at 22 and 22'.

Figure 2A:
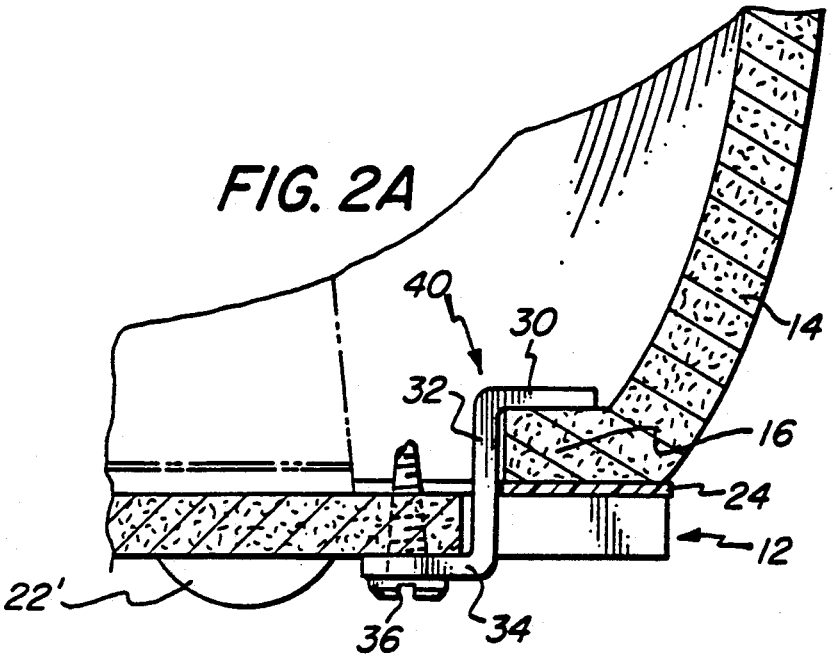
FIG. 2A is a partial enlarged front cross-sectional view of the encasement of FIG. 1A depicting how a base may be secured thereto.
Figure 2B:
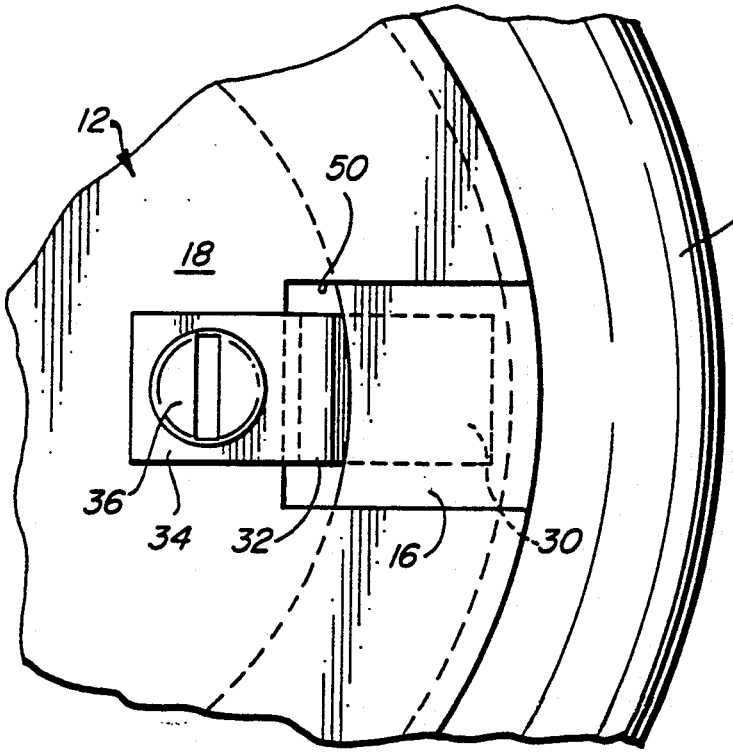
FIG. 2B is a partial enlarged bottom view of the encasement of FIG. 1A depicting how a base may be secured thereto.

Referring now to FIGS. 2A and 2B, a partial enlarged front cross-sectional view and a partial enlarged bottom view respectively of fluid pump 10 depict additional detail of clips 40 and 40'. Each clip includes a body 32 at least long enough to traverse the thickness of lip 16, and two flanges 30 and 34. Flange 30 depends outwardly from one side of body 32 while flange 34 depends outwardly from another side of body 32. In use, body 32 of clip 40 passes through a hole, slot, or notch 50 in base 12, then flange 30 clamps to lip 16 as flange 34 is drawn toward base 12 with a fastener 36 such as a screw. Although two clips 40 and 40' are shown, a single clip or a plurality of clips may be used.

Figure 3:
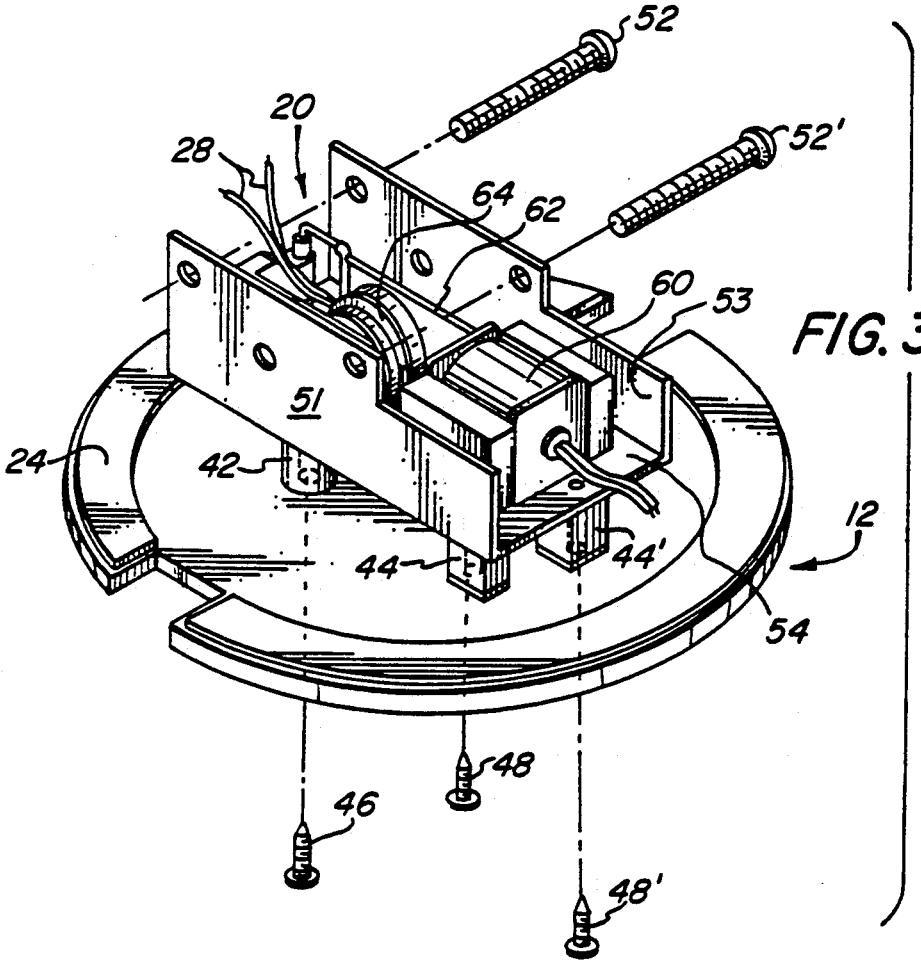
FIG. 3 is a front perspective view of the base showing additional detail of both the fluid pump and how it is mounted to the base as shown in FIGS. 1A and 1B.

Referring now to FIG. 3, a front perspective view of base 12 depicts additional detail of both pumping mechanism 20 and how it is mounted to base 12. Pumping mechanism 20 may be provided, for example, as in U.S. Pat. No. 4,610,608 to Grant. In this regard, pumping mechanism 20 preferably has at least one actuator arm 62, an electromagnet 60 with which to oscillate activator arm 62, and a pump chamber 64 with which oscillating actuator arm 62 creates a pressurized fluid in conduit 28. These elements of pumping mechanism 20 are mounted on a mounting plate 54 which is preferably metal and includes two ninety degree bends to form walls 51 and 53. Mounting plate 54 is then attached to base 12 by any of a variety of vibration absorbing means. For example, rubber members 44 and 44' having nuts incorporated in respective ends thereof receive bolts 48 and 48' to attach base 12 thereto and receive other bolts (not shown) in opposite ends to attach mounting plate 54 thereto. Additionally, a length of vinyl-plastic tubing 42 receives a screw 46 to attach base 12 to one end thereof while another screw (not shown) is used to attach mounting plate 54 to another end thereof.

Figure 4:
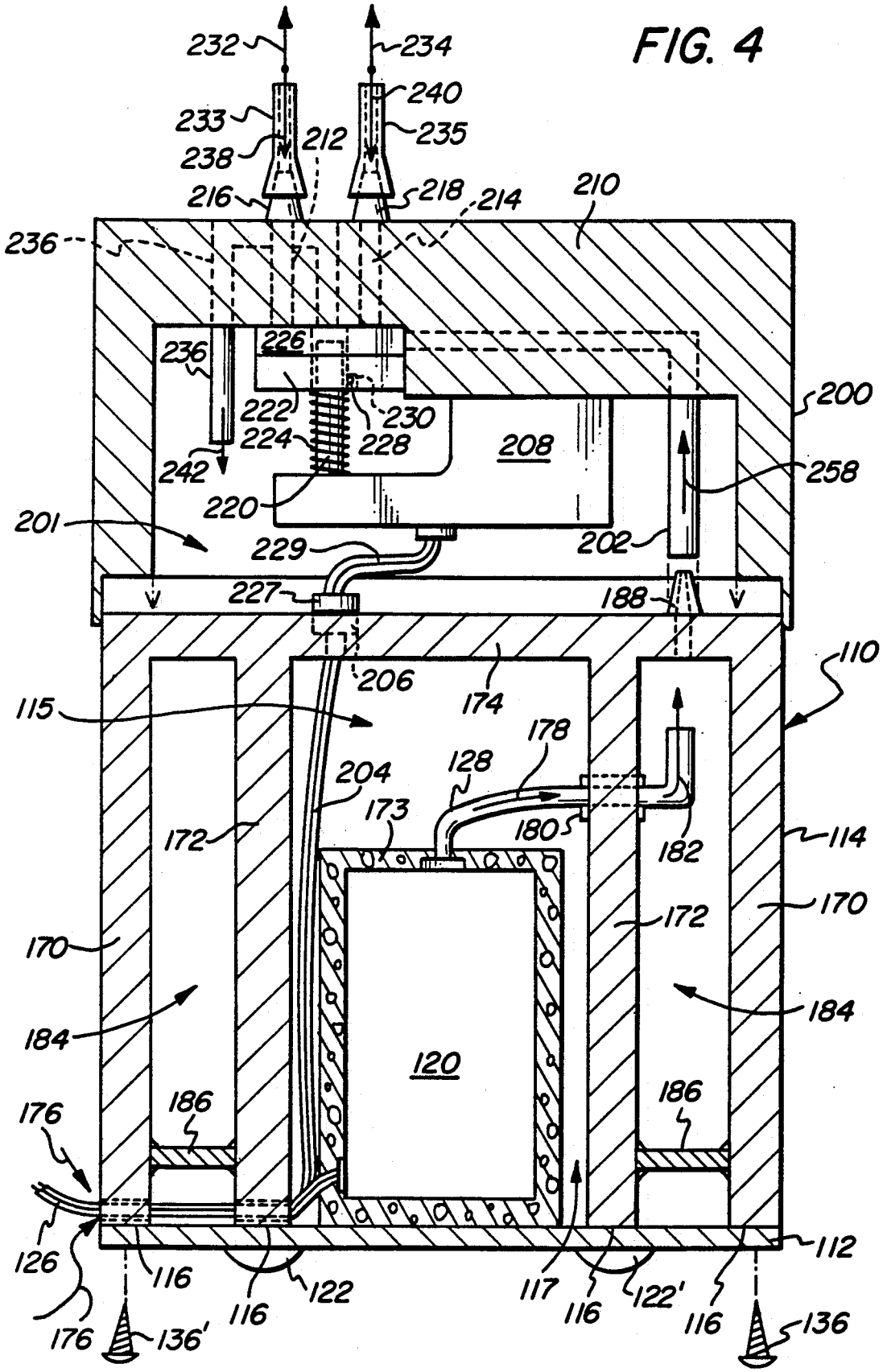
FIG. 4 is a front view of a fluid pump having another embodiment of an encasement in accordance with this invention and depicting, in partially exploded fashion, a timer housing.

Referring now to FIG. 4, a fluid pump 100 is shown in a front view revealing base 112 and another embodiment of an encasement or pump housing 114 in accordance with this invention. Encasement 114 is hollow forming a pump chamber 115 open to one side 117 for receiving and containing a pumping mechanism or fluid delivering means 120 shown schematically. Pumping mechanism 120 may be provided as the same as pumping mechanism 20.

Encasement 114 is substantially formed from a material selected from the group consisting of glasses, ceramics, thermoplastic resins, and thermosetting resins. For this embodiment, thermoplastic resin is preferred. Polyvinyl chloride (PVC) sewer pipe has been found to be a suitable and relatively inexpensive encasement. The encasement is preferably cylindrical in shape with an approximate outer diameter of about 4 inches and an approximate inner diameter of about 3 inches. The encasement may be molded but is preferably extruded.

A curved side wall 170 of encasement 114 may be radially filled with sound absorbing material such as silica, clays, or the like which may provide additional acoustic insulation. Encasement 114 preferably includes, for further muffling of the air pump, a second curved side wall 172 which is formed in place radially inward of and concentric with curved side wall 170. Although, in this embodiment, pumping mechanism 20 is thereby acoustically insulated by two walls of PVC, a single wall may be sufficient. At one end, curved side walls 170 and 172 terminate in top wall 174, and at the other end, curved side walls 170 and 172 terminate in concentric lips 116 which surround open side 117.

Base 112, may be, for example, formed from metals, thermoplastic resin, and thermosetting resin. It has been found that the material used for the base is not critical to the sound and vibration dampening qualities of the encasement so long as the base is of substantial thickness. For this embodiment, thermoplastic resin has been found to be effective. Further, the base is about 4 inches in diameter, at most about ¼ inches thick, and is circular in shape to match the opening of the encasement of this embodiment. Any other shape may be used which conforms to the encasement's opening. Also, vibration absorbing feet 122 and 122' made of rubber, cork, or like material may be attached to base 112.

Fluid pump 110 is assembled relatively quickly and easily from modular components: encasement or pump housing 114, base 112, and pumping mechanism 120. This modular assembly permits relatively quick and easy access to pumping mechanism 120 for repair or replacement. More specifically, base 112 is fastened, for example with screws 136 and 136', in a relatively snug fit to curved side walls 170 or 172 of encasement 114 to close pump chamber 115 after pumping mechanism 120 is placed therein. Unlike pumping mechanism 20 which was mounted to base 12, pumping mechanism 120 is alternatively enveloped in shock absorbing foam rubber 173 or the like and simply placed within pump chamber 115.

In operation, pumping mechanism 120, which may be provided for example as described in U.S. Pat. No. 4,610,608 to Grant, of fluid pump 110 receives air from pump chamber 115 which enters around power cord 126 as indicated at 176. Pumping mechanism 120 delivers a flow as indicated at 178 of pressurized air or other fluid in conduit 128. Conduit 128 is relatively hermetically sealed in curved side wall 172 as indicated at 180. The flow of pressurized air thus enters, as indicated at 182, and pressurizes chamber 184.

Chamber 184 is relatively hermetically sealed by sealing ring 186 which may be fastened and sealed in place between curved side walls 170 and 172 with cement such as epoxy. Sealing ring 186 may be located anywhere between conduit 128 and power cord 126. Chamber 184 must be able to withstand pressures of up to 3 pounds. In addition to helping muffle pumping mechanism 120, chamber 184 also quiets the rush of air flowing through conduit 128.

The pressurized air in chamber 184 is then delivered to the appropriate device, for example a household aquarium or health care apparatus, through a port or nipple 188 located in top wall 174 of encasement 114 and a length of tubing such as TYGON or the like.

The modular design of encasement 114 permits the addition thereto of a timer housing 200. Timer housing 200 may be mounted to the top of encasement 114 by any of a variety of well known means to form a timer chamber 201. As shown, the timer housing simply slides thereover and engages wall 170 of the encasement. A conduit 202, which may be built into timer housing 200 may be fit over nipple 188 of encasement 114. Further a jumper 204 from power cord 126 which may include a socket 206 or other electrical connector is embedded in top wall 174 of encasement 114 to provide power to a timer 208.

Timer 208 which may be mounted to a top wall 210 of timer housing 200 functions to alternately pressurize and exhaust two outlet lines 212 and 214. In this regard, timer 208 comprises a timer motor (not shown), a gear train (not shown), a shaft 220, a rotor 222, a spring 224, and a plate 226. Plate 226 is cemented to top wall 210, and timer 208 is similarly attached to bring shaft 220 into alignment with plate 226. The timer motor is energized by power cord 126 coupled to jumper 204 and socket 206 through connector 227 and line 229. Shaft 220 fits relatively loosely within rotor 222 and plate 226, but includes a key 228 which fits in a slot 230 of rotor 222 enabling rotor 222 to rotate in combination with shaft 220. Pressurized air enters plate 226 through conduit 202, and as rotor 222 rotates the pressurized air is alternately introduced to outlet nipples 216 and 218 and respective outlet tubing 233 and 235 as indicated at 232 and 234. While one outlet is pressurized, the other is relatively simultaneously vented through vent conduit 236 as indicated at 238, 240 and 242. The cooperation of rotor 222 and plate 226 is described more completely below with reference to FIG. 5. Conduits 202, 233, 235 and 236 may be provided, for example, as TYGON tubing, but conduits 202 and 236 are preferably rigid to prevent kinking. Vent conduit 202 may include a rubber, cork, or the like tip for hermetically sealing it to nipple 188 of encasement 114.

Referring now to FIG. 5, an enlarged plan view of rotor 222 and an enlarged plan view of plate 226 reveals additional detail. Plate 226 includes on its inner surface 250 four grooves. Groove 252 for passing air to and from outlet line 212; groove 254 for passing air to and from outlet line 214; groove 256 for receiving air from pressurized chamber 184 and along conduit 202 as indicated at 258; and, groove 260 for passing air to vent conduit 236. Grooves 252, 254, and 256 are each spaced a radial distance X, as indicated, from shaft hole 262. Groove 260, however, is spaced a radial distance 2X, as indicated.

Rotor 222 includes on its inner surface 264 two large identical grooves 266 and 268. Both grooves are spaced at their respective inner edges 270 and 272 a radial distance X, as indicated, from shaft hole 273. Further, both grooves are spaced at both their respective outer edges 274 and 276 a radial distance 2X, as indicated, from shaft hole 273.

Neither size nor shape of the grooves on either the plate or rotor is critical since they are dependent upon both the placement of outlet lines 212 and 214, vent conduit 236, and pressurized source conduit 202; and the desired pressurization and exhaust schedule. Additionally, the pressurized source and exhaust need not be provided via conduits to the plate, but either may be provided around shaft 220 or between, plate 226 and rotor 222 by pressurizing timer chamber 201.

In operation, rotor 222, with its top surface 264 spring biased against bottom surface 250 of plate 226, rotates to cyclically control the pressurization and exhaust of outlet lines 212 and 214. Assume an initial position with groove 268 in alignment with both grooves 252 and 256, and groove 266 in alignment with both grooves 260 and 254. In this position, outlet line 212 will be pressurized with air flowing as at 232 while outlet 214 will simultaneously be vented through vent conduit 236. A short while later, groove 266 will be aligned only with groove 254 and venting will be complete. A short while later, groove 266 will be aligned with both grooves 256 and 254. All the while while groove 268 has remained aligned with both grooves 252 and 256. In this position, the pressure at outlet lines 212 and 214 will rapidly equalize. A short while later, groove 268 will only be aligned with groove 252. A short while later, groove 268 will be aligned with both grooves 252 and 260. In this position, outlet line 212 will begin to vent. Meanwhile, outlet line 214 continues to pressurize. A short while later groove 268 will only be aligned with groove 252. A short while later, groove 266 will be aligned simultaneously with grooves 252, 254, and 256. In this position, the pressure at outlet lines 212 and 214 will rapidly equalize. A short while later, groove 266 will be in alignment with both grooves 252 and 256, and groove 266 will be aligned with both grooves 260 and 254. In this position, after one-half revolution of rotor 222, the cycle begins anew with outlet line 212 being pressurized while outlet 214 is simultaneously vented.

The above description is not meant to describe in detail each and every modification and variation which will be apparent to a person skilled in the art.

What is claimed is:

1. A fluid pump encasement having improved acoustic characteristics comprising:

a base;

a pump housing of a substantially ceramic material forming a chamber open to one side;

a lip depending from the periphery of the open side for mating with the base; and means for clamping the base to the lip to provide relatively quick assembly and disassembly enabling replacement of the hollow sphere for decorative reasons.

2. The fluid pump encasement of claim 1 wherein the pump housing is a hollow partial sphere.

3. The fluid pump encasement of claim 1 including means, mounted to the base, for delivering a fluid under pressure.

4. The fluid pump encasement of claim 1 wherein the clamping means comprises:

at least one slot cut in the base;

at least one substantially Z-shaped clip comprising a body long enough to traverse the thickness of the lip and passing through the slot, a first flange depending from one side of the body, and a second flange depending from another side of the body; and means for fastening the first flange to the base while the second flange is drawn relatively snugly to the lip.

5. An encasement for a fluid pump, the encasement having improved acoustic characteristics and comprising:

a base a pump housing of substantially thermoplastic resin having a top wall, a first curved side wall mounted to the periphery of the top wall to form a pump chamber open to one side, and a second curved side wall mounted to said base radially inward of the first curved side wall forming a second chamber substantially surrounding and insulating the pump chamber;

a port in said pump housing for egress of a fluid under pressure from the fluid pump;

a lip depending from an edge of the first curved side wall opposite the top wall; and means for attaching the base to the lip of the first curved wall in a relatively snug fit to close the pump chamber.

6. The encasement of claim 5 wherein the fluid pump is enveloped in foam rubber and is located within the pump chamber.

7. The encasement of claim 5 including a sealing ring for relatively hermetically sealing the second chamber between the first and second curved side walls for further muffling the fluid pump.

8. The encasement of claim 7 wherein said fluid pump provides fluid under pressure to the relatively hermetic second chamber, and wherein said port is located on said pump housing adjacent the relatively hermetic second chamber.

9. The encasement of claim 5 including a timer housing for mounting to the said pump housing over said port to form a timer chamber.

10. The encasement of claim 9 wherein the timer housing includes valve means mounted thereto within the timer chamber for receiving pressurized fluid from said port and for alternately pressuring and venting a pair of outlets.

11. The encasement of claim 10 wherein the valve means comprises:

a shaft having a spring-loaded rotor;

a plate mounted to the base in alignment with the outlets; and a motor mounted to the base to bring the shaft and rotor into alignment with the plate, the motor for rotating the shaft and rotor to alternately pressurize and vent the outlets through the plate.

12. A fluid pump having improved acoustic characteristics comprising:

a base;

a pump housing having a top wall and a curved sidewall mounted to the periphery of the top wall to form a pump chamber open to one side;

means for mating the base to the curved side wall of said pump housing in a relatively snug fit to close the pump chamber;

pump means for delivering a fluid under pressure;

a port in said pump housing for egress of the fluid under pressure from said pump means;

a timer housing for modular assembly with said pump housing over said port to form a timer chamber;

a pair of outlets attached to said timer housing; and valve means mounted within said timer chamber to said timer housing and in alignment with said pair of outlets for receiving fluid from said port and pressurizing and venting said pair of outlets according to a predetermined schedule.

13. The fluid pump of claim 12 wherein said pump and timer housings are substantially formed from a material selected from the group consisting of ceramics, glasses, thermosetting resins, and thermoplastic resins.

14. The fluid pump of claim 12 wherein said pump and timer housings are substantially formed from thermo-plastic resin and are substantially cylindrical.

15. The fluid pump of claim 12 wherein said pump means is substantially encased in foam rubber and is placed within said pump chamber.

16. The encasement of claim 12 wherein said valve means comprises:

a shaft having a spring-loaded rotor;

a plate mounted to the base in alignment with the outlets; and a motor mounted to the base to bring the shaft and rotor into alignment with the plate, the motor for rotating the shaft and rotor to alternately pressurize and vent the outlets through the plate.

17. The fluid pump of claim 12 including a second curved side wall mounted to said base radially inward and concentric to the curved side wall forming a second chamber substantially surrounding and insulating the pump chamber.

18. The fluid pump encasement of claim 17 including a sealing ring for relatively hermetically sealing the second chamber between the curved side walls for further muffling said pump means.

19. The fluid pump encasement of claim 18 wherein said pump means provides fluid under pressure to the relatively hermetic second chamber and wherein said port is located on said pump housing adjacent the relatively hermetic second chamber.

20. The fluid pump encasement of claim 12 wherein said pump and timer housings are integral extrusions.

21. The fluid pump encasement of claim 12 wherein said pump and timer housings are substantially formed from polyvinyl chloride.

22. A fluid pump having improved acoustic characteristics comprising:

a base;

means for delivering fluid under pressure from a fluid source; and means for encasing the fluid delivery means, the encasing means forming a chamber open to one side for receiving and containing the fluid delivering means, the encasing means further having means formed in the one side for mating with the base in a relatively snug fit;

the encasing means being substantially cylindrical and substantially formed from ceramic material.

23. An encasement for a fluid pump, the encasement having improved acoustic characteristics and comprising:

a base;

a pump housing having a first curved wall to form a pump chamber open to one side and a second curved wall radially inward of the first curved wall forming a second chamber substantially surrounding and insulating the pump chamber;

a port in said pump housing for egress of a fluid under pressure from the fluid pump;

a lip depending from an edge of the first curved wall around said one open side; and means for attaching the base to the lip of the first curved wall in a relatively snug fit to close the pump chamber.

24. The fluid of claim 23 wherein said pump housing is substantially formed from a material selected from the group consisting of thermosetting resins and thermoplastic resins.

25. The fluid pump of claim 23 wherein said pump housing is substantially cylindrical and includes a top wall.

* * * * *